United States Patent [19]

Verbickas et al.

[11] 4,197,731

[45] Apr. 15, 1980

[54] ROLLING MILL CAPABLE OF INCREASED TORQUE TRANSMISSION

[75] Inventors: Robert C. Verbickas, Wolcott; John W. Turley, Oxford, both of Conn.

[73] Assignee: T. Sendzimir, Incorporated, Waterbury, Conn.

[21] Appl. No.: 907,559

[22] Filed: May 19, 1978

[51] Int. Cl.[2] ..... B21B 29/00

[52] U.S. Cl. ..... 72/242

[58] Field of Search ..... 72/242, 243, 241

[56] References Cited

U.S. PATENT DOCUMENTS

| | | | |
|---|---|---|---|
| 2,677,978 | 5/1954 | Dahlstrom | 72/243 |
| 3,049,949 | 8/1962 | Volkhausen et al. | 72/243 |
| 3,128,650 | 4/1964 | Leufven | 72/242 |
| 3,373,590 | 3/1968 | Knappe | 72/243 |
| 3,461,704 | 8/1969 | Rostelli | 72/242 |
| 3,533,263 | 10/1970 | Wochnik et al. | 72/242 |
| 3,724,252 | 4/1973 | Baker et al. | 72/241 |

*Primary Examiner*—Milton S. Mehr

*Attorney, Agent, or Firm*—Frost & Jacobs

[57] ABSTRACT

A rolling mill arrangement is disclosed in which a basically six-high mill has intermediate rolls which have no necks and are supported laterally by side support roller assemblies, and in which the work rolls are also laterally supported, whereby higher torque may be delivered to the mill to obtain heavier reductions without lateral flexure of the intermediate rolls.

2 Claims, 5 Drawing Figures

ROLLING MILL CAPABLE OF INCREASED TORQUE TRANSMISSION

CROSS REFERENCE TO RELATED APPLICATIONS

This application is related to the copending application Ser. No. 880,601 filed Feb. 23, 1978, Ser. No. 883,917, filed Mar. 6, 1978, and Ser. No. 907,502 filed May 19, 1978, now abandoned in favor of a continuation-in-part, Ser. No. 30,368, filed Apr. 16, 1979, all in the names of Verbickas and Turley.

BRIEF SUMMARY OF THE INVENTION

This invention relates to conventional six-high (1-1-1) mills.

As outlined in copending application Ser. No. 30,368 such mills are limited as to the minimum work roll size that can be adopted, unless side support roller assemblies are provided to prevent lateral flexure of the work rolls under the action of drive torque reaction forces.

In a mill according to the present invention a system of side support rollers is used to provide lateral support of the work rolls and intermediate rolls throughout their length. Both work rolls and intermediate rolls float freely in the roll stack, and so have no roll necks or chocks. This construction eliminates drive torque limitations due to neck stresses or lateral flexure of intermediate rolls, and so enables higher drive torques to be transmitted to the mill, and heavier reductions to be obtained.

DETAILED DESCRIPTION

Figure 1:
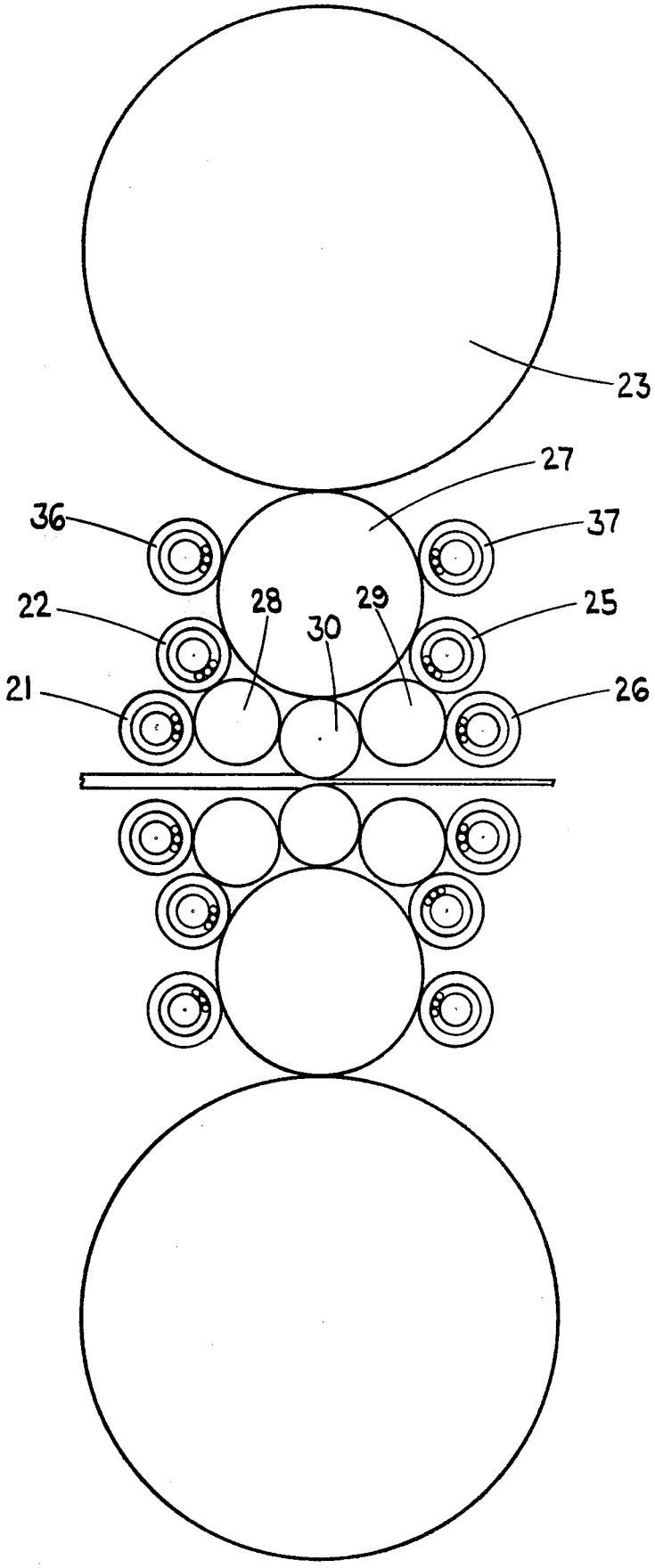
FIG. 1 is a diagrammatic front elevational view of the twenty-two-high roll arrangement according to the present invention.

The basic twenty-two-high arrangement of FIG. 1 contains two clusters, each of said clusters consisting of a work roll 30 supported vertically by an intermediate roll 27 and back-up roll 23, and laterally by the side intermediate rolls 28 and 29, which in turn are supported (both vertically and laterally) by the side back-up rollers 21, 22 and 25, 26 respectively, said intermediate rolls being supported laterally by the side back-up rollers 22, 36, 25 and 37.

Figure 2:
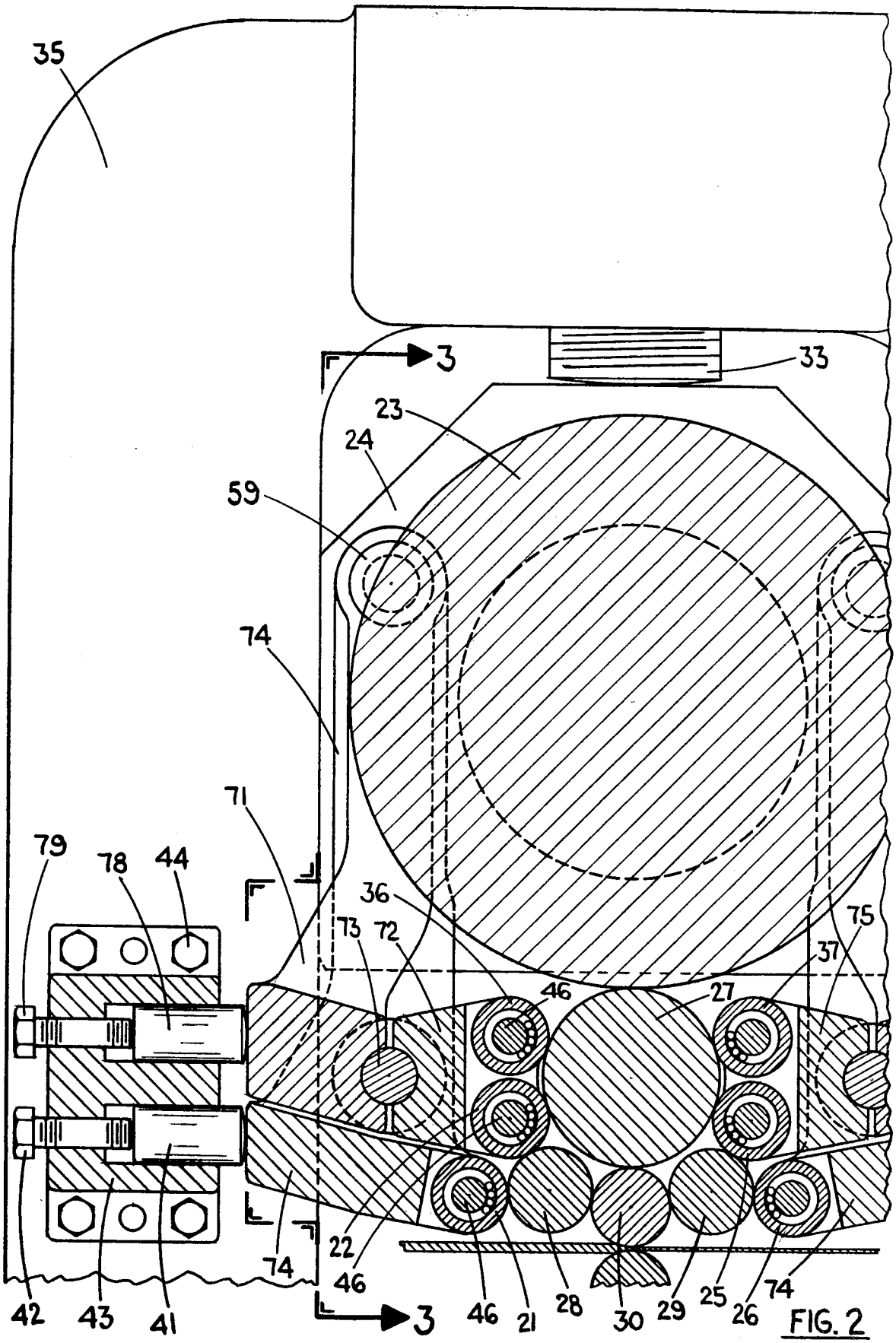
FIG. 2 is a fragmentary front sectional elevational of the upper half of one embodiment of a twenty-two-high mill according to the present invention, showing mounting and adjustment of the side support assemblies.

As shown in FIG. 2, each of the back-up rolls is rotatably mounted in chocks 24 which are slidably mounted in the housing 35. Screws 33 may be used to adjust the roll gap according to the prior art. Drive may be provided to either the back-up rolls or the intermediate rolls. The work rolls 30 and intermediate rolls 27 are not mounted in chocks, but float freely in the stack, as in cluster mills. The intermediate rolls are restrained from lateral movement by the side support roller assemblies.

For each of the said intermediate rolls, there are two identical side support assemblies. These side support assemblies consist of rollers 22 and 36 on one side and rollers 25 and 37 on the other side, the rollers 22 and 36 being mounted in the side support beams 72 and the rollers 25 and 37 being mounted in an identical side support beam 75. The construction and mounting of these side support rollers in side support beams is as described in copending application Ser. No. 6,804.

Figure 3:
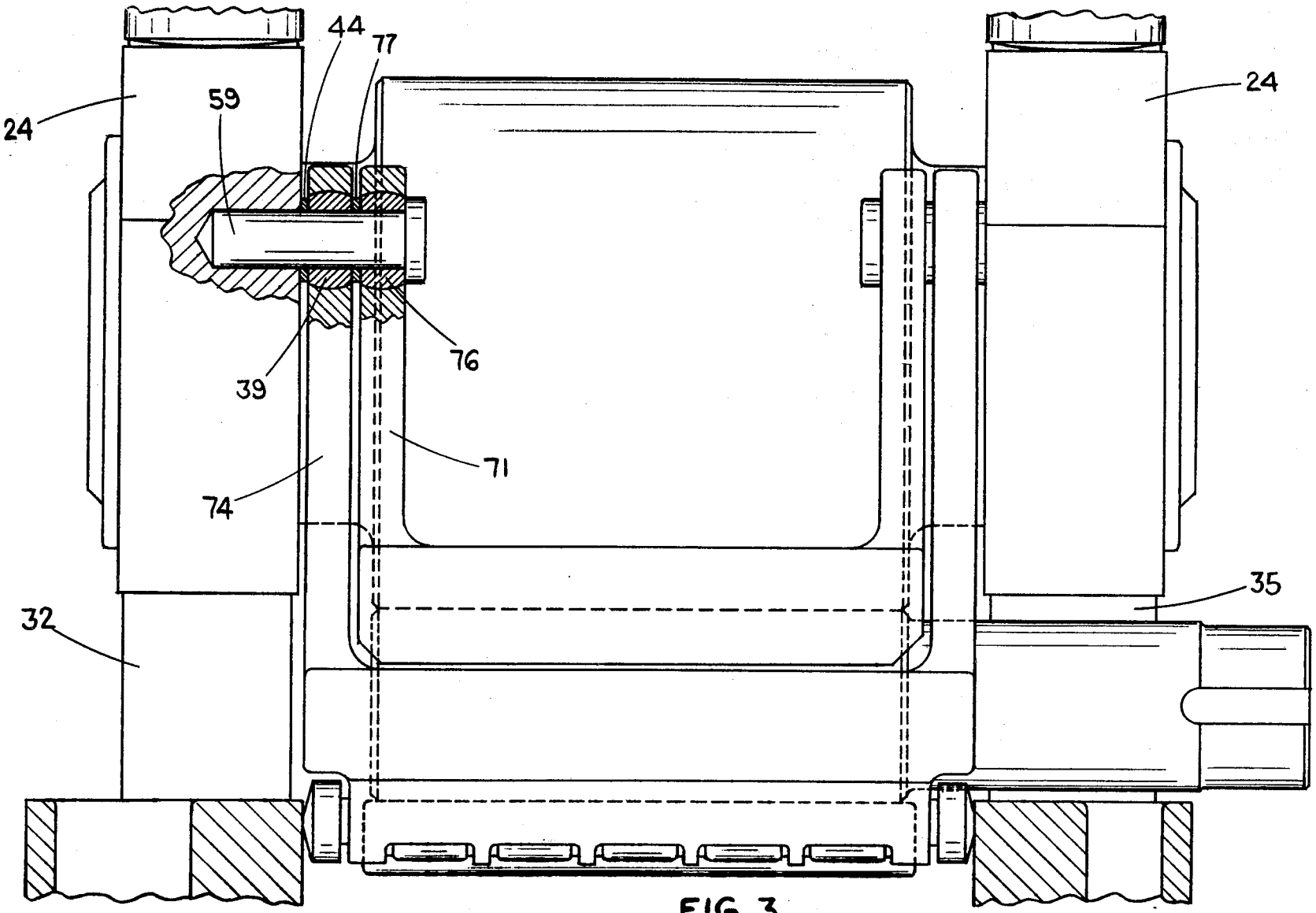
FIG. 3 is a view along the line 3—3 of FIG. 2.

The side support beam 72 is pivotally connected to the yoke 71 by means of a pivot pin 73. As shown in FIG. 3, the yoke 71 is pivotally mounted on, and vertically supported by, the back-roll chocks 24 by means of pins 59, spacers 77 and bushes 76. A spacer beam 43 is mounted between the front housing 32 and the rear housing 35, as described in copending application Ser. No. 907,502. The yoke 71 is supported horizontally by pins 78 slidably mounted in the spacer beam, and these pins can be adjusted axially by adjusting screws 79 mounted in the spacer beam, in order to provide lateral adjustment of the intermediate roll side support assembly, to accommodate different intermediate roll sizes.

Note that the intermediate roll side support rollers 22 and 26 also provide partial side support for the side intermediate rollers 28 and 29.

The work rolls 30 are restrained from sideways movement by the side support rolls 28 and 29 which are themselves fully supported by the side support rollers 21 and 22, and 25 and 26 respectively. The side support rollers 22 and 25 are mounted in the intermediate roll side support beams 72 and 75 as described above.

The work roll side support rollers 21 and 26 are mounted directly in the outer yokes 72 in a similar manner. These outer yokes are pivotally mounted on, and vertically supported by, the back-up roll chocks 24 by means of pins 59, spacers 44 and bushings 39. They are supported horizontally by pins 41 slidably mounted in the spacer beam 43. These pins can be adjusted axially by adjusting the screws 42 mounted in the spacer beam in order to provide lateral adjustment of the work roll side support rollers, to accommodate different work roll and side intermediate roll sizes.

The side intermediate rolls 28 and 29 and work roll 30 are located axially by thrust bearings as described in said copending application Ser. No. 907,502 and the intermediate rolls 27 may be located axially in a similar way, or be provided with axial adjustment means according to the prior art for Sendzimir cluster mill rolls.

The embodiment described above is given by way of example only, and is not intended to limit the scope of the invention.

It is envisaged that mills according to the present invention may also combine prior art features of both conventional four-high mill and cluster mill technology.

For example, the construction of work rolls, side intermediate rolls and their axial thrust bearings may be similar to their counterparts on a Sendzimir cluster mill. The intermediate rolls may be provided with tapers and be axially adjustable as on Sendzimir cluster mills. The intermediate rolls may also have no necks and be driven by a full diameter drive dog arrangement as on Sendzimir cluster mills.

The construction of mill housings, screwdown, pinion stand and back-up rolls and chocks will be basically according to conventional four-high mill technology.

In many cases it will be possible to convert existing four-high and six-high mills to the new twenty-two-high arrangement by replacing the existing roll and chock assemblies with roll and chock assemblies according to the present invention, and mounting a front door, a back plate and spacer beams on the mill housings.

Figure 4:
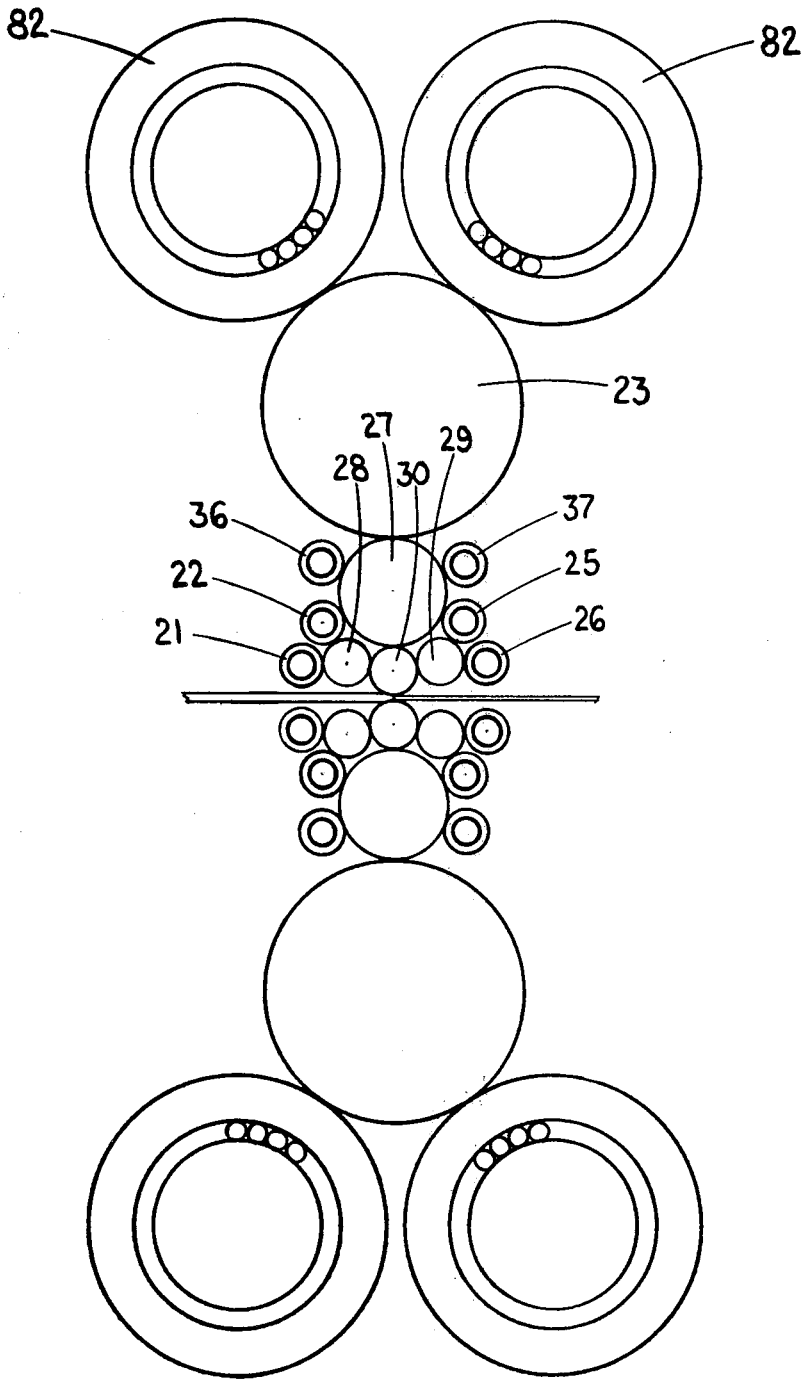
FIG. 4 is a diagrammatic front elevational view of a twenty-six-high roll arrangement incorporating side support means according to the present invention.
Figure 5:
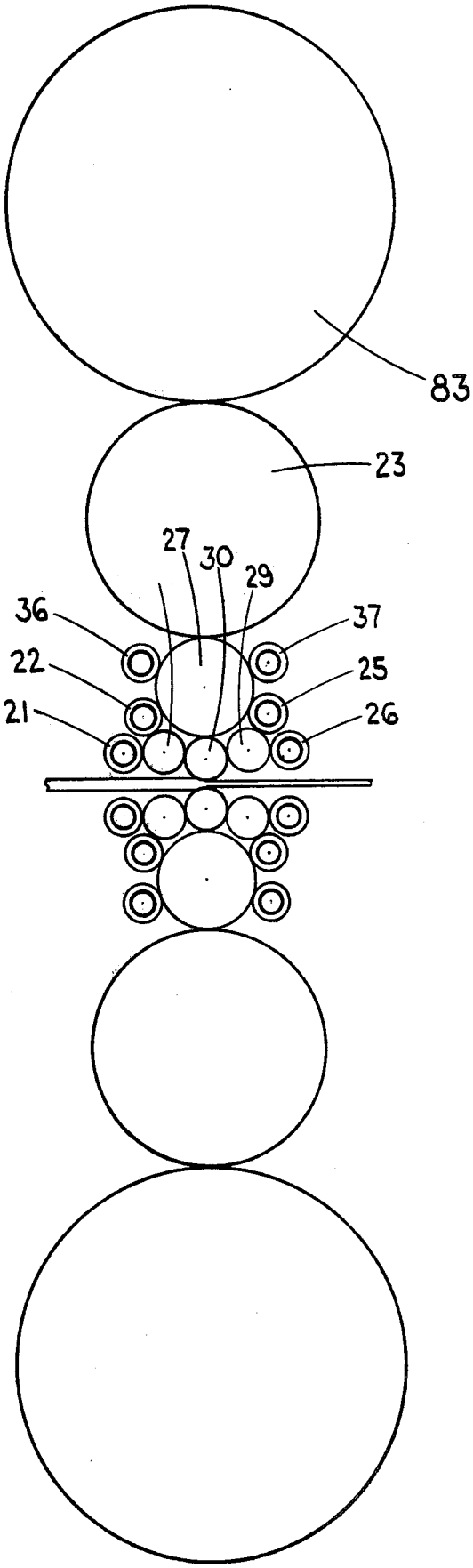
FIG. 5 is a diagrammatic front elevational view of a twenty-four-high roll arrangement incorporating side support means according to the present invention.

The embodiments of FIG. 4 and FIG. 5 are "backed-up" six-high mill configurations, whereby the back-up rolls of the six-high mill are themselves backed up by secondary elements. In FIG. 4 the secondary elements consist of four cluster mill type backing roller assemblies 82 and in FIG. 5 these elements consist of two larger conventional back-up rolls 83. Both of these arrangements include side support elements for the work rolls and the first intermediate rolls according to the present invention. The arrangement of FIG. 4 could be called an improved ten-high (1-1-1-2) or a twenty-six-high arrangement. The arrangement of FIG. 5 could be called an improved eight-high (1-1-1-1) or a twenty-four-high arrangement. Clearly there is no limit to the number of roll combinations possible to give vertical "backing-up" to the basic six-high stack, and clearly the side support arrangement according to the present invention can be adopted in all such cases, provided that, for all these cases, a basic six-high configuration (1-b 1-1) is adopted, where a pair of work rolls, a pair of first intermediate rolls, and a pair of back-up rolls are all mounted in the same vertical plane.

We claim:

1. A rolling mill arrangement comprising an opposed pair of work rolls, a main intermediate roll and a backing roll for each of said work rolls, all of said rolls having their axes in a single vertical plane, a side intermediate roll contacting each side of each of said work rolls, a first pair of side back-up rolls contacting each side of each of said main intermediate rolls, a second pair of side back-up rolls contacting each side of each of said intermediate rolls and side intermediate rolls, and a third pair of side back-up rolls contacting each of said side intermediate rolls, all of the rolls associated with each of said work rolls constituting a cluster each of said main intermediate rolls being the only rolls directly driven.

2. A rolling mill with a roll arrangement according to claim 1 wherein, for each cluster, the backing roll is mounted in chocks, the work roll, intermediate roll and side intermediate rolls float freely in said cluster, and said side back-up rolls each consist of several rollers rotatably mounted upon stationary shafts, said shafts being mounted in, and supported at intervals throughout their length, by an adjustable stationary rigid support beam.

* * * * *